US005655349A

United States Patent [19]

Ghali et al.

[11] Patent Number: 5,655,349

[45] Date of Patent: Aug. 12, 1997

[54] STUD-THROUGH REINFORCING SYSTEM FOR STRUCTURAL CONCRETE

[76] Inventors: Amin Ghali, 3911 Vincent Drive NW., Calgary, Alberta, Canada, T3A 0G4; Walter Dilger, 592 Dalmeny Hill NW., Calgary, Alberta, Canada, T3A 1T6

[21] Appl. No.: 577,155

[22] Filed: Dec. 22, 1995

[51] Int. Cl.[6] ..... E04C 3/20; E04C 5/00

[52] U.S. Cl. ..... 52/724.1; 52/334; 52/414; 52/600; 52/724.2

[58] Field of Search ..... 52/251, 260, 334, 52/600, 649.2, 649.8, 710, 724.1, 724.2, 726.2, 729.1, 730.2, 336, 414, 720.1, 729.2, 601, 602, 690

[56] References Cited

U.S. PATENT DOCUMENTS

| | | | |
|---|---|---|---|
| 1,696,039 | 12/1928 | Kane | 52/693 |
| 1,738,614 | 12/1929 | Ritchie | 52/649.2 X |
| 1,839,178 | 12/1931 | Rebman | 52/691 |
| 4,052,833 | 10/1977 | Beine | 52/710 |
| 4,406,103 | 9/1983 | Ghali et al. | 52/260 |
| 4,739,601 | 4/1988 | Beine | 52/710 |
| 4,901,498 | 2/1990 | Gerwick, Jr. . | |
| 4,918,899 | 4/1990 | Karytinos | 52/690 |
| 5,519,978 | 5/1996 | Sucato et al. | 52/690 |

FOREIGN PATENT DOCUMENTS 1085642 9/1980 Canada .

OTHER PUBLICATIONS

Journal of American Concrete Institute, vol. 77, No. I, Jan./Feb. '80 pp. 28–35, F. Seible, A. Ghali and W.H. Dilger.

"T–Headed Stirrup Bars", *Concrete International*, American Concrete Institute, vol. 13, No. 5, pp. 49–53, Dale E. Berner et al, May 1991.

"Effectiveness of Shear Reinforcement in Slabs", *Concrete International*, Jan. 1992, pp. 60–65, Amin Ghali and Neil Hammill.

*Bautechnick*, vol. 42, Oct. 1965, F. Leonhardt and R. Walther.

"Shear Reinforcement for Slabs", American Concrete Institute, ACI Committee 421, Feb. 1993, pp. 421. IR–I to R–9.

*Primary Examiner*—Michael Safavi

*Attorney, Agent, or Firm*—Thomas E. Malyszko

[57] ABSTRACT

A reinforcing assembly for use in structural concrete members, such as slabs, footings, raft foundations, beams, walls and columns, has at least one reinforcing stud having an elongate stem and an anchor head at least at one end of the stem for anchoring the stud adjacent a face of the concrete member, and an elongate support element for mechanically retaining therein the anchor head of the stud. The support element is in the form of a U-shaped trough having a base and sidewalls which hold the stud and confine the concrete about the retained anchor head. The trough decreases the size of anchor head necessary to avoid concrete crushing behind the anchor head and distributes some anchorage forces away from the anchor head. The trough also spaces and positions a plurality of studs in the concrete member.

19 Claims, 5 Drawing Sheets

STUD-THROUGH REINFORCING SYSTEM FOR STRUCTURAL CONCRETE

FIELD OF THE INVENTION

The present invention relates to a reinforcing system for structural concrete members such as slabs, footings, raft foundations, beams, walls and columns, and in particular to a shear reinforcing system using studs.

BACKGROUND OF THE INVENTION

In comparison to steel, concrete is a very weak material in tension. It reacts poorly to shear forces which create significant tensile forces, typically along inclined planes running between exterior surfaces of a reinforced concrete member.

Without shear reinforcement, shear failure in reinforced concrete members is brittle and occurs without much warning. A shear failure generally takes place by widening of an inclined crack which propagates from the face of the concrete member which is in tension to the compression face. In comparison, a flexural failure of a reinforced concrete member is much more ductile and provides more warning prior to the failure of the flexural reinforcement because of the formation of cracks readily visible to the naked eye and the relatively large deflections of the concrete member.

Shear reinforcement in the form of stirrups and cross ties is provided to prevent shear failure. Stirrups resist tensile forces in reinforced concrete caused by: shearing in beams, corbels, bridge piers and walls; punching in slabs and walls; lateral expansion in columns; and splitting behind anchorages and below bearings, at points of concentrated loading.

A stirrup is typically a reinforcing bar bent in a "U", "L" or closed box shape. The ends of the bar are usually in the form of hooks. A reinforcing bar, running in a direction perpendicular to the plane of the stirrup, is commonly lodged inside the hooks or the bends of the stirrups. Stirrups in a flat concrete slab, for example, contribute to shear resistance by developing tensile forces in the vertical legs of the stirrup. These tensile forces arise when the stirrup leg is intercepted by a crack forming in the slab. However, such tensile forces cannot develop unless the stirrup leg is anchored effectively at both its ends to prevent it from being pulled out. This anchorage is provided by the bend of the stirrup at its comers or by the hooked ends. A small slip in this anchorage reduces the effectiveness of the stirrup. The slip prevents the tension in the short stirrup leg from reaching its yield strength, and so the full capacity of the stirrup is not realized.

Cross ties function in much the same way. A cross tie is a stirrup in the form of an "L" and is commonly provided with one hook at the upper end of the "L". A cross tie is sometimes made in the form of one straight bar with two hooks; but this is difficult to install.

Should the tension in a stirrup leg (or a cross tie) approach its yield strength, very high compressive stresses are developed and exerted on the concrete in contact with the inner face of the bend or hook. By virtue of the commonly used radii for such bends (and as allowed by the American Concrete Institute (ACI) Building Code and the Codes of other jurisdictions), these compressive stresses are sufficient to crash the concrete inside the bend, resulting in a measurable slip of the leg and dislocation of the hook. Such slip causes large strain losses in the leg and diminishes the stirrup's capacity to prevent the widening of a crack. The loss of strain, and hence the loss of force resisted by the stirrup leg, is large because the stirrup leg tends to be short, particularly in slabs and walls.

The above noted slippage has been reported in the *Journal of American Concrete Institute* (Vol. 77, No. 1, January/February 1980, pp. 28–35, by F. Seible, A. Ghali and W. H. Dilger) and in *Bautechnik* (Vol. 42, October 1965, by F. Leorkhardt and K. Walther (in German)).

Use of stirrups and cross ties also presents other problems: they are difficult to form properly; installing flexural reinforcement through rows of stirrups, often required in two orthogonal directions, is extremely difficult and time consuming; and stirrup congestion in high shear locations makes it difficult to pour and vibrate concrete. Consequently, given a choice, many designers would prefer omitting closed stirrups in reinforced concrete design.

Solutions to some of the above-noted problems associated with stirrups and cross ties have been proposed by the present inventors in Canadian Patent 1,085,642 issued Sep. 16, 1980 and U.S. Pat. No. 4,406,103 issued on Sep. 27, 1983, which describe stud shear reinforcement for flat concrete slabs. One form of this stud shear reinforcement comprises a plurality of spaced, substantially vertical steel rods fixed at the bottom to a flat supporting base plate. The top of each rod has an anchor head to provide anchorage of the reinforcement within the concrete slab. The anchor head is mechanically attached to the stem of the stud, usually by forging, cold forming or welding. This reinforcement has enjoyed wide acceptance and use in the construction industry.

A vertical stud of the prior patents which crosses a crack in a slab will prevent the crack from widening provided that no slip occurs, at least until the yield stress of the stud is reached. To avoid slippage, the anchor head must be sufficiently large so that the concrete behind (i.e. on the stem side of) the head does not crush while the tensile force in the stem of the stud remains below its yield strength. On the other hand, the size of the anchor head should not be so large as to make forging impossible or too costly, it should not complicate the placement of flexural reinforcement, nor should it interfere too much with the casting of concrete in congested areas. It has been generally accepted that an anchor head should have an area about 10 times the cross-section area of the intermediate stem of the stud to avoid crushing of concrete, depending on the quality and strength of the concrete used. In some circumstances the size of the anchor head necessary to avoid crushing may result in a clearance between adjacent anchor heads which is rather tight, making arrangement of the longitudinal bars needlessly inconvenient and difficult.

The studs of the prior patents are welded at a pre-set spacing to the elongate base plate prior to placement in concrete formwork. Such welding is rather expensive and slows production time of the stud shear reinforcement. The welding process is also difficult to do on-site, and hence the stud shear reinforcement is almost always produced off-site in a shop What is desired therefore is a novel stud reinforcing system which overcomes the limitations of these other prior reinforcing systems. Preferably it should allow convenient off-site or on-site placement of studs at a desired spacing on a support element and avoid having studs welded at a pre-set spacing to a base plate. The support element should allow use of a reduced size of anchor head by providing confinement of highly stressed concrete behind the anchor head. It should be possible to use the stud reinforcing system to resist tension associated with shear and in situations where the full yield strength of the stud is needed to resist tension immediately behind the anchor head. It should also provide for the anchor heads of a stud to be arranged as close as possible to the external faces of a concrete member to maximize the length of the stud and its chances of intersecting cracks formed in the concrete member.

SUMMARY OF THE INVENTION

In one aspect the invention provides a reinforcing assembly for use in a structural concrete member comprising: at least one reinforcing stud having an elongate stem and an anchor head at least at one end of the stem for anchoring said stud adjacent a face of said concrete member; and, an elongate support element for mechanical retention therein of said anchor head of said stud.

In another aspect the invention provides a reinforcing assembly for use in a structural concrete member comprising: a plurality of reinforcing studs, each stud having an elongate stem with opposed first and second ends; and, an elongate support element for receiving and retaining said first ends of said plurality of studs in a spaced relationship, said support element including confinement means for confining concrete about said first ends.

In yet another aspect the invention provides a device for supporting at least one elongate reinforcing stud in a structural concrete member, said stud having an anchor head at least at one of its ends for anchoring said stud adjacent a face of said concrete member, said device comprising an elongate support element for mechanical retention therein of an anchor head of said stud, and for positioning said retained stud in said concrete member.

In a further aspect the invention provides a device for confining concrete about an anchor head of a reinforcing stud in a structural concrete member comprising a U-shaped body having a base portion and sidewalls extending from said base portion for engaging said anchor head and retaining said body on said anchor head, wherein said sidewalls confine said concrete about said anchor head.

DESCRIPTION OF THE DRAWINGS

Embodiments of the invention will now be described, by way of example only, with reference to the accompanying drawings, wherein:

FIG. 5 is an elevational view of the stud-trough assembly placed in a slab adjacent a column or resisting punching shear;

FIG. 6 is an elevational view of two possible arrangements of the stud-trough assembly in a raft foundation or footing for resisting punching shear;

FIG. 7 is a plan view of the stud-trough assembly in a wall or column in lieu of cross ties;

FIG. 8 is an elevational view of the stud-trough assembly in a corbel; and

FIG. 9 is an elevational view of the stud-trough assembly in a beam for resisting splitting forces due to prestressing action.

DESCRIPTION OF PREFERRED EMBODIMENTS

Figure 1:
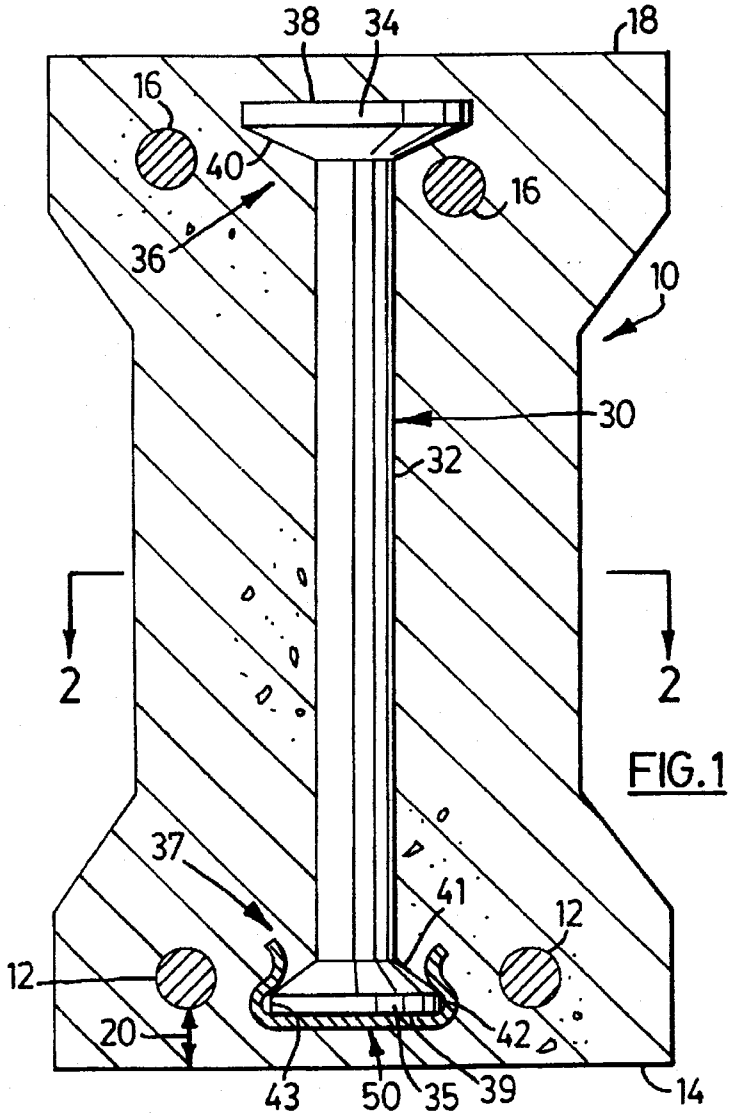
FIG. 1 is an elevational side view of a double headed stud and trough assembly according to one embodiment of the present invention embedded within a concrete girder (shown in cross-section along line 1—1 of FIG. 2)

Reference is first made to FIG. 1 which shows in cross-section a structural concrete member in the form of an I-shaped reinforced concrete girder or beam 10. Typically such beams have numerous lower longitudinal reinforcing bars 12 embedded within the beam 10 near its lower face 14 primarily for resisting flexural tension due to sagging bending moments exerted on the beam. Likewise, several upper longitudinal/reinforcing bars 16 are located near an upper face 18 of the beam for resisting flexural tension in the beam, and the like. The quantity and exact placement of the flexural reinforcement 12, 16 will depend on local code requirements, anticipated loading, design preferences, and the like. The asymmetrical placement of the upper flexural reinforcement 16 is for illustrative purposes as discussed later. It will be assumed that a distance 20 between the lower flexural reinforcement 12 and the lower face 14 of the beam is at least the minimum clear concrete cover required by code. At least the same dear cover should be observed at the top of the beam. It will be appreciated by those skilled in the art that FIG. 1 is not drawn to scale.

A preferred embodiment of a reinforcing assembly according to the present invention, shown in FIG. 1, generally comprises a plurality of spaced studs 30 supported in a trough 50 for resisting shearing forces in the beam 10. Each stud 30 has an elongate cylindrical stem 32 and anchor heads 34 and 35 at its top and bottom ends respectively. The anchor heads are fixed to the stem by cold forming, hot forging, welding or any other suitable means. The top and bottom anchor heads 34, 35 may be the same or of different sizes and shapes, as required. In the FIG. 1 embodiment, the top anchor head is not retained in a trough and thus is larger than the bottom anchor head to avoid crushing of concrete, as will become apparent later.

The stud 30 prevents or controls the width of cracks which intersect the stud. In doing so, the stem 32 is subjected to a tensile force which in turn causes the concrete behind each anchor head 34, 35 to be subjected to high compressive stresses. The term "behind" is used to identify an area near the juncture of an anchor head and stem as indicated by numerals 36 and 37 for anchor heads 34 and 35, respectively. Hence, as discussed earlier, an anchor head must be sufficiently large to avoid crushing the concrete behind the head before the stud reaches its yield strength.

One or both anchor heads should be shaped for insertion and a snug fit in the trough 50. In the FIG. 1 embodiment the anchor heads have generally flat outside surfaces 38, 39. The underside 40 of the top anchor head 34 is tapered, usually at about 10 degrees, to facilitate the escape of air during casting of the concrete. The underside 41 of the bottom anchor head 35 may also be tapered as shown or it may be made generally flat if desired since air rises during casting. Each anchor head 34, 35 is generally circular in plan view, although bottom anchor head 34 has two opposed cut-off portions 42 and 43 (best seen in FIGS. 2 & 2*a*), each having a length "J", to provide more contact area between the head 35 and trough 50, and therefore enhance the hold of the trough on the stud as discussed below. Good results have been achieved with a length J of about 0.4 E, where E is the diameter of the circular portion of the bottom anchor head 35 as indicated in FIG. 2*a*. It is noted that an anchor head without such cut-offs is also acceptable, as are heads of various shapes (for example, square, hexagonal, etc.) as long as a proper fit within the trough is achieved. A tight or snug fit is preferred to allow on-site workers to step or walk on the studs 30 without dislodging the studs from the trough or altering their spacing.

Figure 2:
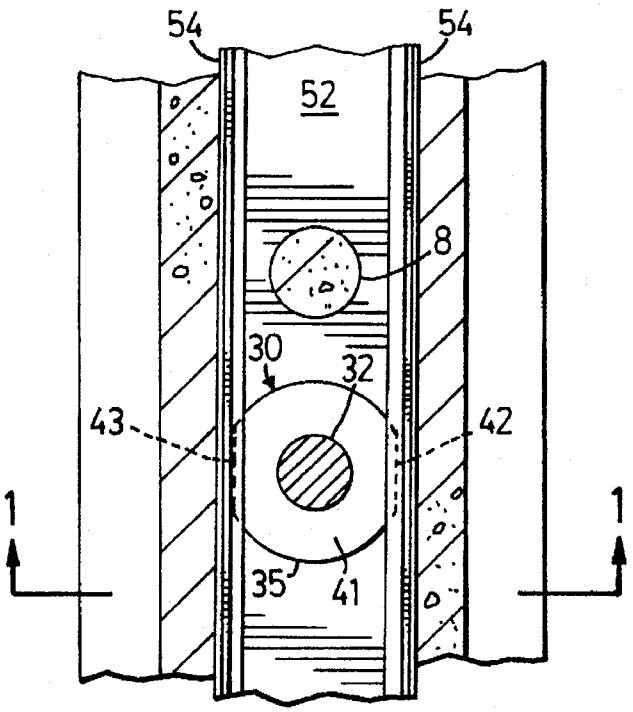
FIG. 2 is a sectional plan view of FIG. 1 along line 2–2, excluding flexural reinforcement.
Figure 2A:
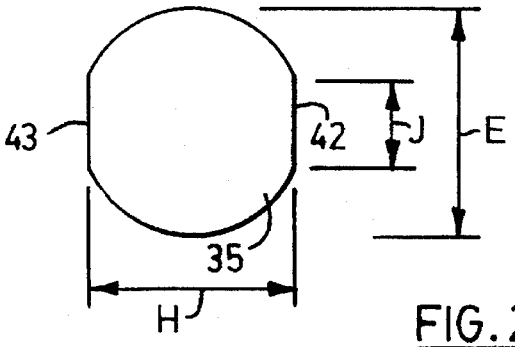
FIG. 2*a* is an isolated view of an anchor head shown in FIG. 2.
Figure 4:
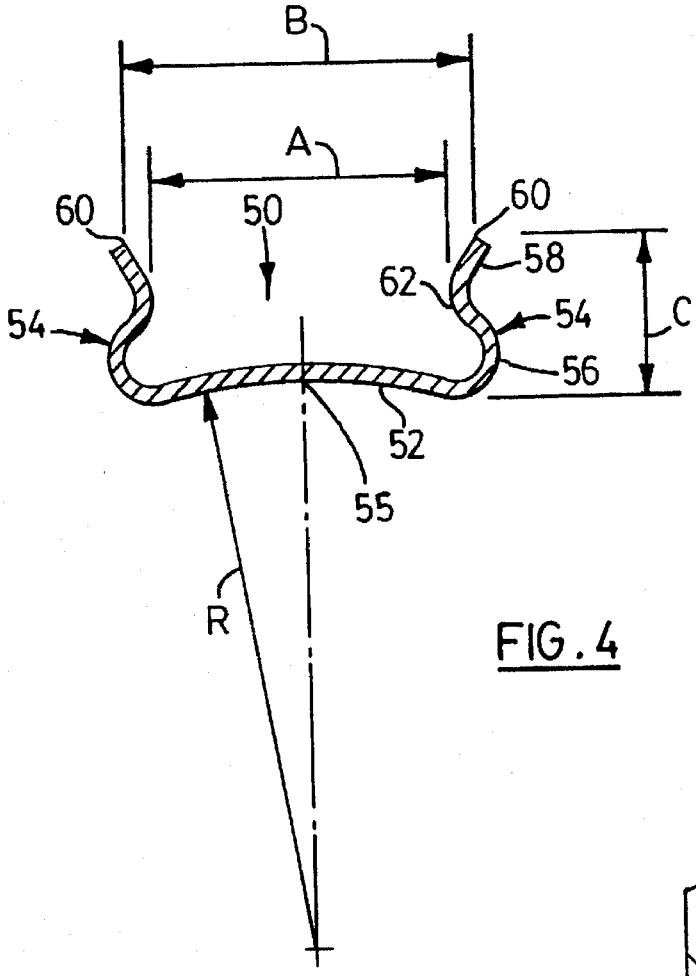
FIG. 4 is a detailed cross-sectional view of the trough of FIG. 1 with the stud removed.

Referring now to FIGS. 1, 2 and 4, in the preferred embodiment the trough 50 is generally U-shaped and formed from a single piece of steel plate. Referring first to FIG. 4 which shows the trough 50 in isolation prior to insertion of any studs, the trough 50 has an elongate base portion 52 and sidewalls 54 extending generally perpendicularly, or "upwardly", from opposed longitudinal sides of the base portion 52. The base portion 52 is cambered inwardly (i.e. upwardly in FIG. 4) of the U-shape having a radius of curvature "R".

In this embodiment the sidewalls 54 are mirror images of each other about the longitudinal centerline 55 of the trough 50. The trough need not be symmetrical about the longitudinal centerline, although this is not preferred. Each sidewall 54 is generally S-shaped having an inwardly curved inner part 56 and an outwardly inclined or cantilevered outer part 58. The sidewalls 54 have a flexural rigidity which allows them to deflect outwardly of said U-shape to receive a stud anchor head. This flexural rigidity and the shape of the inner part 56 act as a biaser for the sidewall 54 to urge the sidewall back onto the inserted anchor head.

The outer edges 60 of the outer part 58 of each sidewall 54 are spaced a distance "B", whereas elbows 62 formed by the inner and outer parts 56, 58 of each sidewall constrict the opening of the U-shape to a distance "A". "C" represents the height of the trough 50. In the stud-trough arrangement according to the preferred embodiment, good results have been achieved using a trough 50 proportioned as follows:

a) Referring to FIG. 4, the height C of the trough is about 1.1 D, where D is the diameter of the stem 32 of the stud;

b) The radius of curvature R of the camber of the base portion 52 is about 1.5 E, where E is the diameter of the bottom anchor head 35 as shown in FIG. 2*a;* c) The dimension B, namely the distance between the outer edges 60, is about 0.95 E; and d) The dimension A, namely the opening of the trough between the elbows 62 before insertion of the stud, is about 0.75 E.

The thickness of the sheet material from which the tough is formed depends on the type of material used and the proportioning of the trough, which in turn is influenced by the size of anchor head to be retained in the trough. The smaller the size of the confined anchor head relative to the diameter of the stud, the thicker the trough material should be to increase its stiffness. When the trough is made out of steel plate, for example, the steel's yield strength will influence the thickness of the plate.

Insertion of the stud 30 into the trough 50 is achieved by pushing the anchor head 41 with sufficient force against the sidewalls 54 to flex them outwardly and allow the head to pass by the elbows 62 and lodge itself in the trough as shown in FIG. 1. Preferably one of the cut-off portions 42 or 43 of the anchor head 41 are first placed into the opening formed by the inner part 56 of the trough, and then the other cut-off portion pushes the elbow 62 outwardly to allow the anchor head to snap into place. Hence, the inclined surface of the outer part 58 is used as a lever or cam to help flex the sidewalls 54 outwardly to get by the obstruction formed by the elbows 62. Upon entry of the anchor head 41 in the trough 50, the outside surface 39 of the head pushes against and substantially flattens the initially cambered base 52. The base 52 therefore provides a spring-like action which pushes or urges the anchor head against the elbows of the sidewalls and firmly holds the stud in the trough.

The trough 50 performs many functions. First, as described above, it helps to mechanically retain or hold the stud 30 in a desired position in formwork for reinforced concrete members. As shown in FIG. 1, the trough 50 holds the stud 30 vertically in the beam, and provides a clear cover 20 at the bottom of the beam by using conventional chairs (not shown). The top of the stud 30 may either be tied to the upper flexural reinforcement 16 (for instance to the right hand bar 16 as viewed in FIG. 1) or the trough 50 may hold the stud 30 away from the flexural reinforcement (as with bar 16 to the left of the stud). Furthermore, placement of the stud-trough assembly may take place either before, during or after placement of the flexural reinforcement 12, 16 and other structural elements in the formwork, whichever option is more convenient or desirable.

Figure 7:
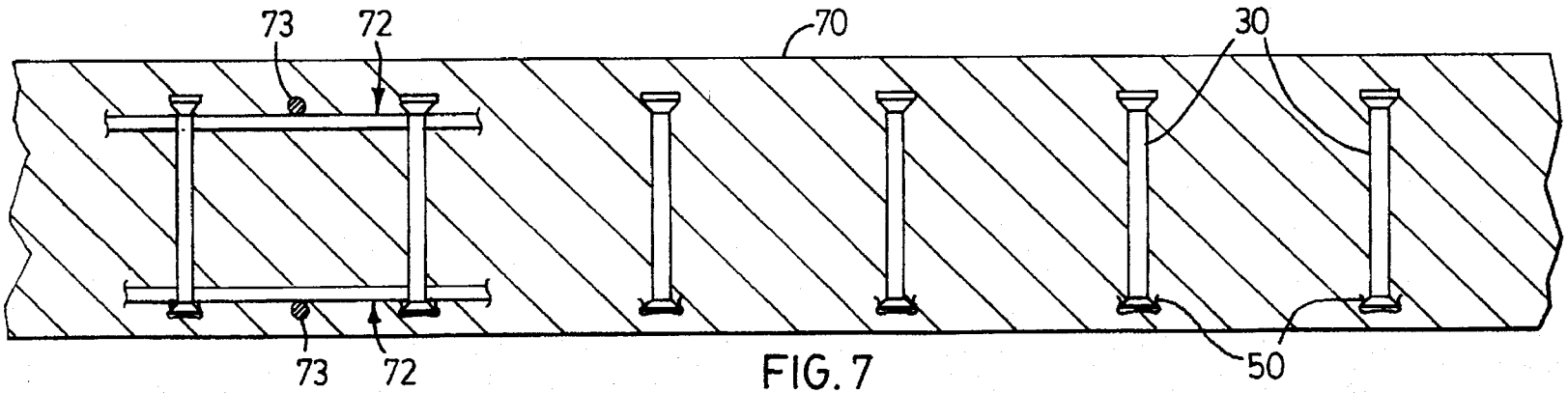
Figure 8:
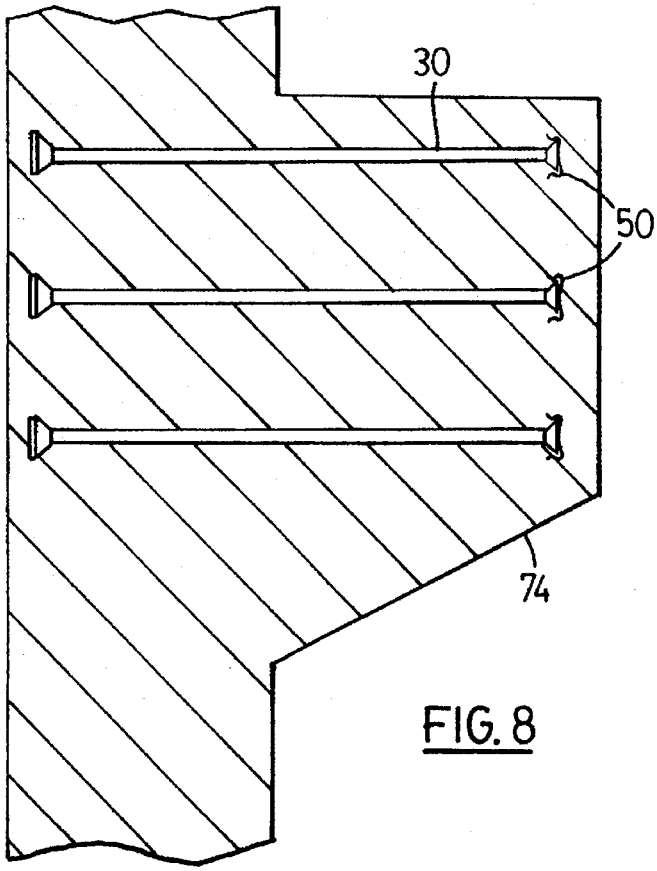

While the stud 30 has been depicted positioned in a vertical orientation, it will be appreciated that the stud-trough system may be used to hold the stud in other non-vertical positions. For instance, the longitudinal axis of the trough 50 may be positioned vertically in a wall 70 (see FIG. 7) to hold the studs 30 horizontally amongst horizontal and vertical reinforcing bars 72, 73, respectively; or the trough 50 may be placed horizontally on its side within a corbel 74 (FIG. 8) to hold the studs horizontally amongst other reinforcement (not shown).

Figure 5:
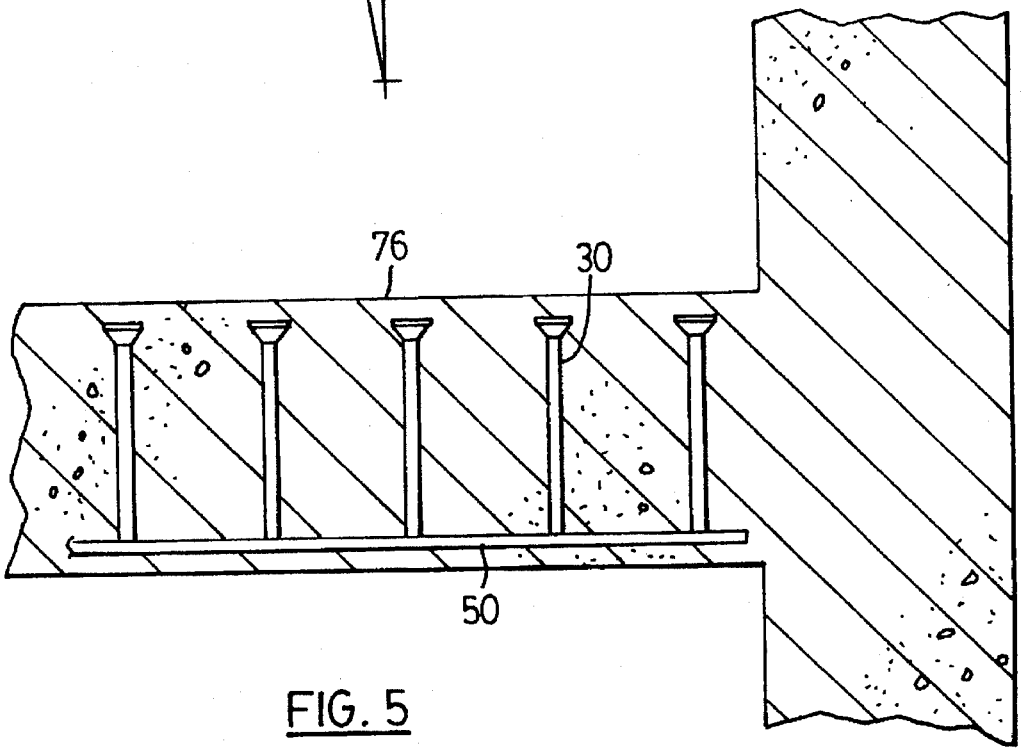
FIGS. 5 to 9 are sectional views of the stud-trough assembly of the present invention in various reinforced concrete members, specifically.
Figure 9:
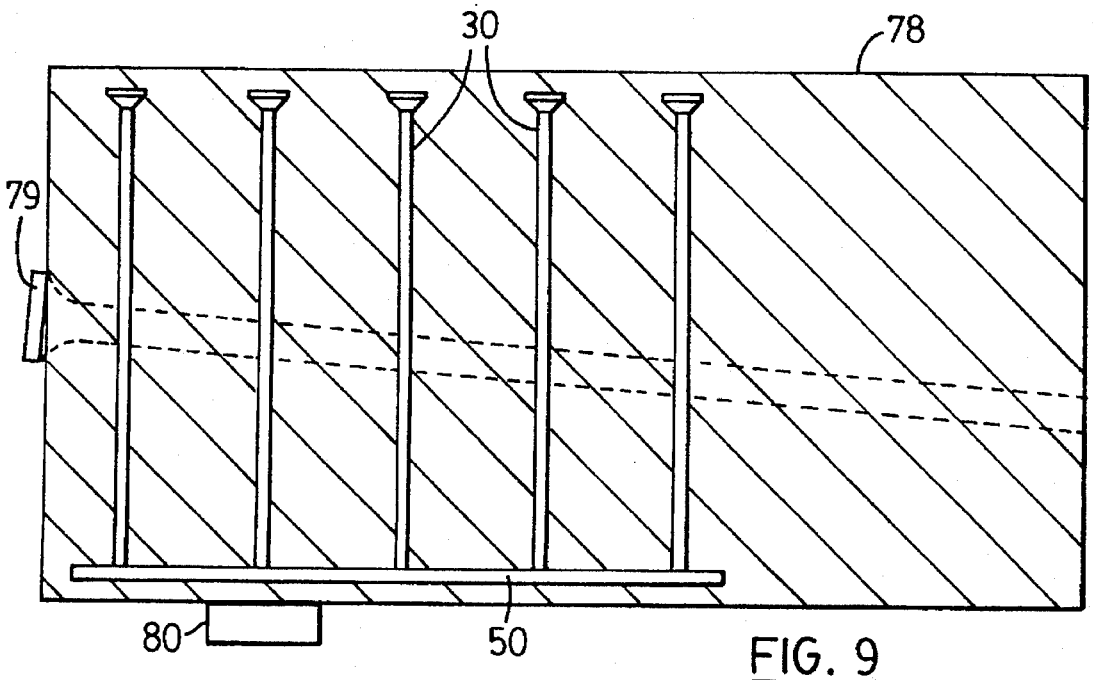

Second, the trough 50 also provides for spacing of the studs 30 relative to one another as desired for different uses. The trough 50 may accommodate a relatively tight stud spacing in shallow concrete members, such as in a slab 76 (FIG. 5). The same trough might also be used for a relatively wider spacing in deep concrete members, such as in a prestressed beam 78 (FIG. 9). In the FIG. 9 embodiment the studs 30 are arranged to resist tensile forces created by an anchor 79 of a prestressing tendon. The stud-trough arrangement of FIG. 9 may also be used to resist the tensile forces created by large concentrated forces as they occur in the vicinity of bearing supports 80 of heavy structures, such as bridges, although it will be appreciated that the studs 30 would be re-aligned horizontally to resist such splitting forces.

Third, the shape of the trough 50 and the flexural rigidity of its sidewalls 54 function to confine the concrete immediately behind the anchor head 35. Referring to FIGS. 1 and 4, the concrete behind the anchor head 35 (indicated by reference numeral 37) is confined between the outwardly flared outer part 58 of the sidewall 54 and the tapered surface 41 of the anchor head, and to some extent by the stem 32. Such confinement increases the compressive strength and reduces the brittleness of the confined concrete, and so allows the use of a smaller anchor head than an "unconfined" anchor head (such as anchor head 34) without increasing the risk of concrete crushing. To illustrate, the established practice noted earlier would be to make the area of outside surface 38 of the unconfined anchor head 34 about 10 times the cross-section area of the stem 32 to avoid crushing of concrete behind the head (at 36). The trough 50 of the present invention allows the outside surface 39 of the "confined" anchor head 35 to have a comparatively smaller area than outside surface 38, the difference being influenced by the degree of confinement provided by the trough 50.

Fourth, the trough 50 distributes some of the anchorage forces away from the anchor head 35. The trough's U-shaped profile provides it with flexural rigidity in the longitudinal direction. This flexural rigidity assists in transferring a portion of the anchorage force over a part of the length of the tough, and hence to the concrete on either side of the anchor head 35. This mechanism contributes to the above noted ability to reduce the size of the anchor head.

Figure 3:
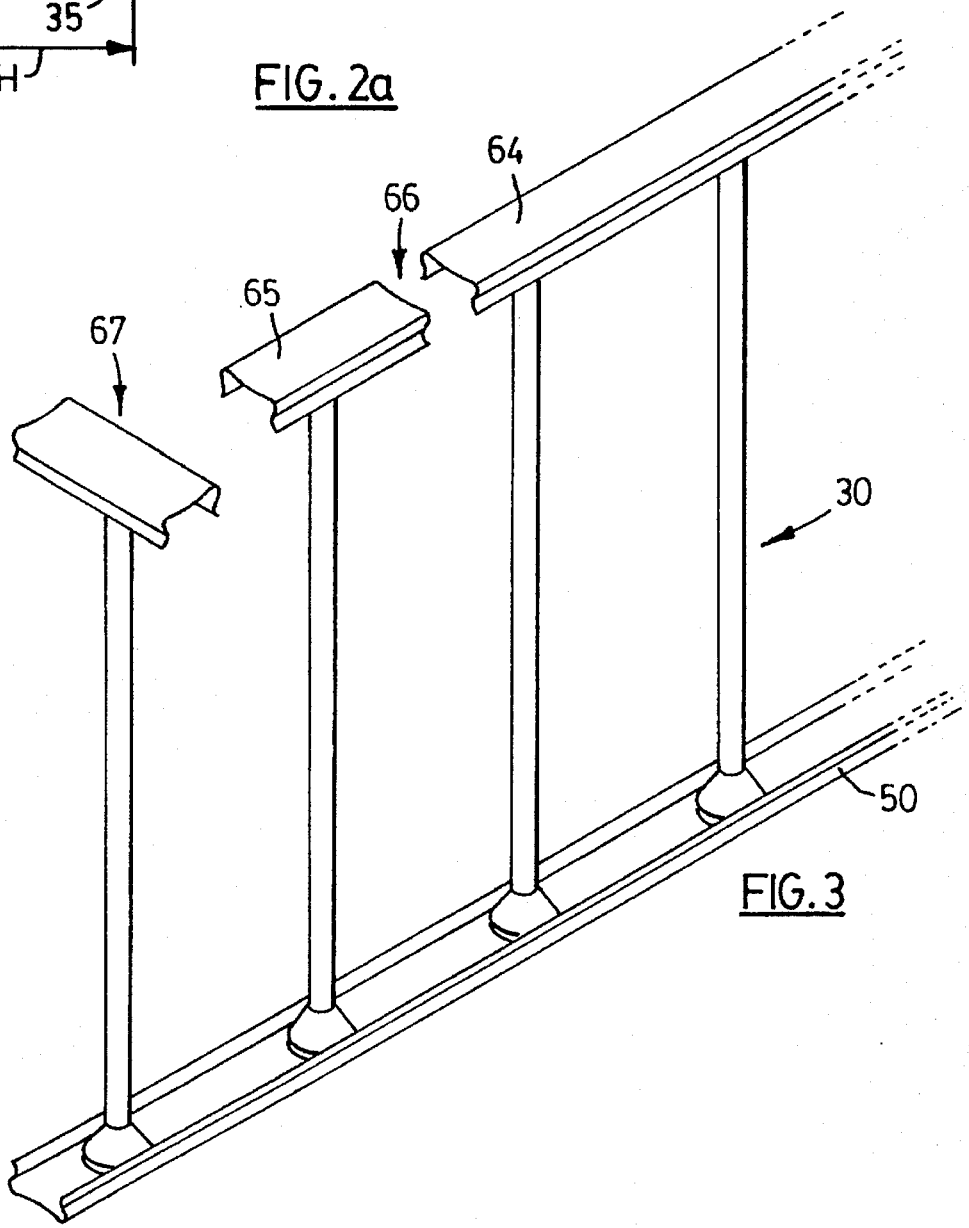
FIG. 3 is a perspective view of a portion of a stud-trough assembly according to another embodiment the present invention.
Figure 6:
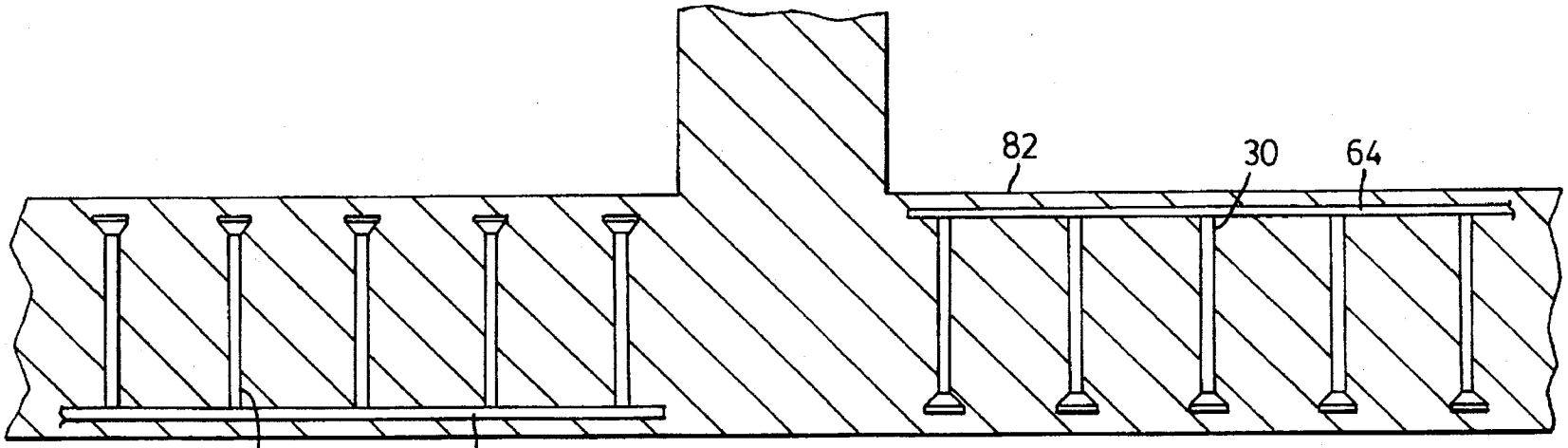

Although FIG. 1 shows the trough inserted only on the bottom anchor heads 35, a trough may also be inserted on the top anchor heads as shown in FIG. 3. Insertion of a trough on the "unconfirmed" anchor head should be considered where both anchor heads are of the same size. A continuous top trough, as indicated by reference numeral 64, may be used if it does not complicate the placement of other reinforcement, as in the beam 10 where the flexural reinforcement would run parallel to the trough 64. Where flexural reinforcement runs in orthogonal directions, such as in a floor slab, the continuous top trough 64 could interfere with and complicate placement of the flexural reinforcement. Hence, a segmented trough 65 may be used wherein a gap 66 between adjacent segments facilitates the placement of other reinforcement. To increase the gap 66 without having to shorten the segment 65, the segment may be rotated 90 degrees, as indicated at 67, or as desired. It will also be appreciated that in certain applications it may be desirable to place the studs 30 using only a top trough 64, as shown on the right-hand side arrangement of the raft foundation 82 in FIG. 6. It is also understood that use of a top trough on stud 30 may be avoided if the top "unconfined" anchor head 34 is made larger than the bottom "confined" anchor head 35 to equalize the concrete crushing thresholds at both ends of the stud 30.

Referring again to FIG. 1, it is desireable to maximize the length of stud to be used in the beam 10 in order to maximize the chances that the stud will intersect a crack forming in the beam. With only the minimum clear concrete cover 20 provided below the trough 50 and above the top anchor head 34 to protect against fire, corrosion and cracking, the longest permissible stud in the beam 10 will therefore be approximately the thickness of the slab 10 minus the sum of the top and bottom concrete covers. The cover 20 below the trough 50 is provided by chairs (not shown) which elevate the trough above the formwork, and intermittent openings 68 in the base portion 52 of the trough (see FIG. 2) facilitate the flow of concrete below the trough (i.e. between the trough and the formwork) during casting to avoid air pockets and the like.

It will now be apparent that the present invention provides a more efficient form of reinforcement in concrete members than conventional stirrups and cross ties made of bent reinforcing bars. The superior efficiency results in the use of fewer studs and larger spacings therebetween as compared to stirrups and cross ties. It will also be apparent that it should be possible to use the present stud-trough reinforcing system not only to resist tension associated with shear, but also in situations where the full strength of the stud 30 is needed to resist tension immediately behind the anchor head 35 due to the superior anchorage of the anchor head 35 in the concrete member 10.

In an alternate embodiment of the present invention, the anchorage provided by the stud-trough assembly may be provided at only one end of a stud or bar in tension. In such an embodiment the bar may have an anchor head at one end of its stem for insertion into a trough and may omit an anchor head at the other end, relying instead on the bond between the concrete and the stem to provide necessary anchorage. Conventional lap splices may be used to splice the stem with longer bars or other reinforcement, thereby transferring tension from the stem to the longer bar. For example, a relatively short bar with a stud-trough arrangement at one end may be spliced onto the end of a flexural reinforcing bar in a beam to anchor the flexural reinforcement adjacent an end face of the beam. As mentioned above, the anchorage provided by the stud-trough arrangement allows the full strength of the reinforcement to be relied upon immediately behind the anchorage. Other examples where such anchorage is typically required are deep beams, pile caps and, more generally, beams with a narrow end support subjected to bending moments which vary rapidly with the distance from the support.

As an alternative to inserting the anchor head of a stud into a pre-formed trough as discussed earlier, it will be understood that such "insertion" may be accomplished by folding or bending a steel plate about the anchor head. Hence, the forming of the trough and insertion of the stud therein is combined into a single step, and the outward flexing of the sidewalls during insertion as described earlier is avoided. In a further embodiment therefore, the flared outer parts 58 of the sidewalls 54 used for flexing the sidewalls outwardly may be omitted, and so the trough functions to simply hold and space the studs from one another. Since the confining effect of the flared outer parts 58 is omitted, it will be understood that the size of the anchor head retained in the trough would approach that of an "unconfined" anchor head. In the FIG. 1 view, for example, the bottom anchor head 35 would have to be about the same size as the top anchor head 34.

Other advantageous uses of the stud-trough assembly is in structures with a circular concrete wall, such as a cylindrical storage tank or silo. The horizontal reinforcing bars in such a wall typically follow its circular perimeter adjacent to the wall's faces. A tensile force in a bar adjacent to the wall's inner face tends to push the concrete inwards in a radial direction, thus separating the concrete covering the bar from the remainder of the wall. Such spalling is commonly avoided by cross-ties, for which the stud-trough system of the present invention may be substituted. The placement of the studs in such circular walls would be similar to that shown in FIG. 7 for the flat wall 70, namely the studs 30 would run in a radial horizontal direction between the curved faces of the wall.

The above description is intended in an illustrative rather than a restrictive sense and variations to the specific configuration and materials described may be apparent to skilled persons in adapting the present invention to specific applications. Such variations are intended to form part of the present invention insofar as they are within the spirit and scope of the claims below. For instance, satisfactory results may also be achieved by substituting the steel of the trough 50 with other metals or plastics with are equal or superior in performance or cost. Another variation may be to make the individual trough segment 65 circular and have it fit on the stud 30 much like a bottle cap to provide the desired concrete confinement. Yet another variation may be the substitution of studs 30 with I-shaped segments cut from standard I-section beams and the like wherein the flanges of such segments and the trough 50 are adapted to fit one another. A further modification might be to incline the stud 30 relative to the trough as opposed to the perpendicular orientation of the stud 30 relative to the trough 50 in the preferred embodiment. For instance, the anchor head 35 may be fixed at an inclined angle relative to the stem 32, or the outside surface 39 of the bottom anchor head 35 may itself be inclined.

We claim:

1. In a reinforced structural concrete member having generally opposed first and second faces, a shear reinforcing assembly embedded within said structural concrete member comprising at least one shear-resisting stud secured to an elongate support element located adjacent said first face of said concrete member, said stud having an elongate rod-like stem, a first plate-like anchor head at a first end of said stem for anchoring said stud adjacent said first face of said concrete member, and a second plate-like anchor head at a second end of said stem for anchoring said stud adjacent said second face of said concrete member, and said elongate support element forming a generally U-shaped trough in cross-section defined by a base portion and opposed sidewalls extending therefrom, wherein said first anchor head engages said base portion and is mechanically retained within said U-shaped trough by said opposed sidewalls.

2. The reinforcing assembly of claim 1 wherein said support element further includes confinement means for confining concrete on the stem side of said first anchor head.

3. The reinforcing assembly of claim 2 wherein said confinement means comprises an outer part of each sidewall cantilevered outwardly of said U-shape.

4. The reinforcing assembly of claim 2 wherein at least one of said sidewalls is biased to said base portion for flexing outwardly of said U-shape to allow said first anchor head to be inserted into said support element and for urging said sidewall inwardly to retain said first anchor head in said support element.

5. The reinforcing assembly of claim 4 wherein each of said sidewalls has an inner part curved inwardly of said U-shape for retaining said first anchor head in said support element.

6. The reinforcing assembly of claim 5 wherein an outer part of each sidewall above said inner part is curved outwardly of said U-shape for engaging an outside surface of said first anchor head and for urging the inner part of said sidewall outwardly when inserting said first anchor head into said support element.

7. The reinforcing assembly of claim 5 wherein said base portion of the support element is cambered inwardly of said U-shape for urging said first anchor head against said sidewalls to firmly retain the first anchor head in the support element upon insertion therein.

8. The reinforcing assembly of claim 2 wherein said first anchor head has opposed cut-off portions for contacting said opposed sidewalls to enhance said mechanical retention.

9. The reinforcing assembly of claim 2 wherein openings penetrating said base portion at predetermined locations facilitate the flow of concrete into said U-shaped trough and about the support element during casting.

10. The reinforcing assembly of claim 1 wherein said stem is of a solid cylindrical form, and wherein said second anchor head has a cross-section area of generally 10 times the cross-section area of said stem, and said first anchor head has a smaller cross-section area than that of said second anchor head.

11. The reinforcing assembly of claim 1 wherein said second anchor head is secured to another of said support elements.

12. The reinforcing assembly of claim 11 wherein said support element secured to said first anchor head is adapted to engage a plurality of studs, and said support element secured to said second anchor head is adapted to engage a single stud.

13. A reinforced concrete structure comprising:

a) at least one concrete member; and b) at least one reinforcing assembly embedded within said concrete member, said assembly comprising:

a plurality of shear-resisting studs secured to an elongate support element, each of said studs having a generally cylindrical elongate stem and an enlarged generally rounded plate-like anchor head at least at one end of said stem, said elongate support element forming a generally U-shaped trough in cross-section defined by a base portion and opposed sidewalls extending therefrom, wherein said anchor head is mechanically retained at a selected location in said trough by said base portion and said opposed sidewalls.

14. The reinforced concrete structure of claim 13 wherein said support element further includes confinement means for confining concrete on the stem side of said anchor head.

15. The reinforced concrete structure of claim 14 wherein said confinement means comprising a portion of said base and sidewalls adjacent said anchor head.

16. An assembly for shear reinforcement of a structural concrete member comprising at least one shear-resisting stud secured to an elongate support element, said stud having a generally cylindrical elongate stem and an enlarged generally rounded plate-like anchor head at each end of said stem, said elongate support element forming a generally U-shaped trough in cross-section defined by a base portion and opposed sidewalls extending therefrom, said opposed sidewalls forming a continuous slot therebetween, wherein one of said anchor heads of said stud is firmly held in said trough at a selected location along said slot by said base portion and said opposed sidewalls, said stud extending away from said base portion through said slot.

17. The assembly of claim 16 wherein said support element further includes confinement means for confining concrete on the stem side of said anchor head held in said support element, said confinement means comprising a portion of said base and sidewalls adjacent said anchor head held in said support element.

18. The assembly of claim 17 wherein portions of said sidewalls furthest from said base portion are flared outwardly of said U-shape away from said anchor head held in said support element to provide said confinement.

19. The assembly of claim ∫wherein said anchor head held in said support element has a smaller cross-section area than that of said anchor head at the opposite end of said stem, said anchor head at said opposite end of said stem having a cross-section area of generally 10 times the cross-section area of said stem.

* * * * *

UNITED STATES PATENT AND TRADEMARK OFFICE

CERTIFICATE OF CORRECTION

PATENT NO. : 5,655,349
DATED : August 12, 1997
INVENTOR(S) : Amin Ghali et al.

It is certified that error appears in the above-identified patent and that said Letters Patent is hereby corrected as shown below:

Title page,
Item [54] "Stud-Through" should read as -- Stud-Trough --; and before item [56] References Cited insert the following:
-- [30] Foreign Application Priority Data
Dec. 21, 1995 [CA] Canada .....2,165,848 --.

Column 10, claim 19,
Line 1, "claim ∫" should read as -- claim 17 --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*